United States Patent [19]

Gottsegen

[11] 3,982,654

[45] Sept. 28, 1976

[54] PLASTIC CASE SYSTEM

[76] Inventor: Robert S. Gottsegen, 10 Harwood Terrace, Leominster, Mass. 01453

[22] Filed: Aug. 21, 1974

[21] Appl. No.: 499,373

[52] U.S. Cl. ..... 220/21; 206/427; 206/503; 220/23.6

[51] Int. Cl.[2] ..... B65D 21/02

[58] Field of Search ..... 220/21, 23.6; 206/427, 206/503

[56] References Cited

UNITED STATES PATENTS

| | | | |
|---|---|---|---|
| 2,535,493 | 12/1950 | Gerber | 220/21 |
| 3,103,278 | 9/1963 | Kuzma | 220/23.6 |
| 3,214,056 | 10/1965 | Box | 220/23.6 |
| 3,332,574 | 7/1967 | Earp | 220/21 |
| 3,333,727 | 8/1967 | Belcher | 220/21 |
| 3,701,449 | 10/1972 | Schoeller | 220/21 |

*Primary Examiner*—George E. Lowrance
*Attorney, Agent, or Firm*—Cesari and McKenna

[57] ABSTRACT

A plastic case system composed of a multilayered stack of identical cases or plastic cases mixed randomly with similar cases made of other material for holding arrays of upstanding containers in which all but the lowermost cases are keyed to the crowns of the containers in the underlying cases. The cases are shaped and arranged so that they can be placed side-by-side in one stack layer configuration, yet still be keyed to the crowns of containers in the underlying cases arranged in the same or a different stack layer configuration so that cases in different layers can criss-cross one another and interlock to maximize stack stability.

7 Claims, 10 Drawing Figures

PLASTIC CASE SYSTEM

BACKGROUND OF THE INVENTION

This invention relates to a plastic case system. It relates more particularly to a system of this type in which substantially identical plastic cases for holding arrays of containers are arranged in a multilayered stack of cases with the cases being keyed to the crowns of the containers in the underlying cases.

Plastic cases for holding containers of tonic, soda, or the like have generally replaced the wood fiber case formerly used for this purpose. The case is molded of a suitable impactresistant plastic and is dimensioned to hold an array of containers of a given size. Preferably, the case is capable of holding 12 bottles larger than 26 ounces in capacity arranged in three rows with four bottles in each row. Also, the case may be provided with integral dividing walls to separate the containers and thus minimize the chances of their being impacted against one another during handling. Examples of such cases are shown in U.S. Pat. Des. 201,307, 209,864 and 3,265,237.

A major drawback with the prior plastic cases of this general type is that they can only be stacked in register one on top of the other. In other words, a stack can be formed composed of single case layers and several stacks can be placed side-by-side to form a stack composed of multiple-case layers. With such an arrangement, the adjacent stacks of cases provide some mutual support; but there is no connection between different cases in the same layer or between the adjacent stacks. Consequently, when the cases are stacked relatively high, e.g., four or five layers, the outer stacks become unstable and sometimes tip over onto the ground.

An attendant disadvantage of prior systems is that the cases tend to slide on conveyor rolls and belts because of the low coefficient of friction of the plastic material.

Accordingly, an object of the invention is to provide a plastic case system composed of a multilayer stack of similar cases which is unusually stable as compared with prior systems of this general type.

Another object of the invention is to provide a plastic case for holding an array of containers which can easily be arranged in several different orientations in a stack of similar containers.

Other objects will in part be obvious and will in part appear hereinafter.

The invention accordingly comprises the features of construction, combination of elements and arrangement of parts which will be exemplified by the following detailed description, and the scope of the invention will be indicated in the claims.

SUMMARY OF THE INVENTION

Briefly, the present system comprises a plurality of identical, generally rectangular plastic cases for holding arrays of upstanding containers such as tonic, soda or the like. When full, these cases are arranged in a multilayer stack and there are usually a plurality of cases placed next to one another in each layer. The cases in each layer above the first are arranged and adapted to rest on the crowns of the containers in the next underlying layer. Furthermore, the underside of each case contains a multiplicity of recesses or keyholes into which protrude the crowns of the underlying containers to prevent lateral shifting of the cases in the different layers of the stack.

However, instead of the cases in each layer having to be in register with the cases below them, they are arranged and adapted so that the cases in a given layer can be oriented at right angles to the cases below it so that each case is keyed to containers in at least two underlying cases, with the result that those underlying cases are locked together. Thus, when building a stack of cases, all or some of the stack layers can be criss-crossed in this fashion, with the adjacent cases in some or all of the layers locked together so that the resultant stack can be quite high, yet stable.

Also, high coefficient of friction grommets are located on the undersides of the cases so that they do not slip on conveyors as they are being moved about.

In a typical system, each case may be dimensioned to contain twelve larger than 26 ounce bottles arranged in three columns of four bottles each. These filled cases are arranged in a five-layer stack. The first layer comprises two rows of three cases arranged side-by-side, thereby forming a square 3 feet on a side. This is just the proper size to fit on a standard 3 foot square pallet to facilitate transporting the cases. The next two layers are arranged in the same way with each case being in register with one below it so that the undersides of these cases are keyed to the crowns of the bottles in the underlying cases. The fourth layer, however, is oriented 90° relative to the underlying three layers so that each case in the fourth layer overlies at least two cases in the third layer. With this orientation, the cases in the fourth layer are keyed to the crowns of bottles in at least two different cases in the third layer, with the result that all six cases in the third layer are locked together by the cases in the fourth layer.

The fifth or uppermost layer in the stack is also composed of six cases and these are arranged in the same way as the cases in the first three layers. Thus, they too are keyed to the bottles in at least two different cases in the fourth layer so that all of the cases in the fourth layer are locked together. This same procedure may be followed to build the stack with alternate case layers criss-crossed 90° so that an exceptionally stable stack can be formed.

Of course, the individual layers in the stack can be composed of multiples of the basic six-case arrangement, with all of the cases being interlocked as described above. Also, when 3 × 4 ft. or 3 × 5 ft. pallets are being used, one or two additional cases can be added to each row in each layer. In this event, interlocking is achieved by staggering the cases in each layer back and forth.

Thus, the present system should reduce the incidence of container breakage when full cases are stacked, particularly when the stacks have to be made relatively high.

BRIEF DESCRIPTION OF THE DRAWINGS

For a fuller understanding of the nature and objects of the invention, reference should be had to the following detailed description taken in connection with the accompanying drawings, in which.

DECRIPTION OF THE PREFERRED EMBODIMENT

Figure 1:
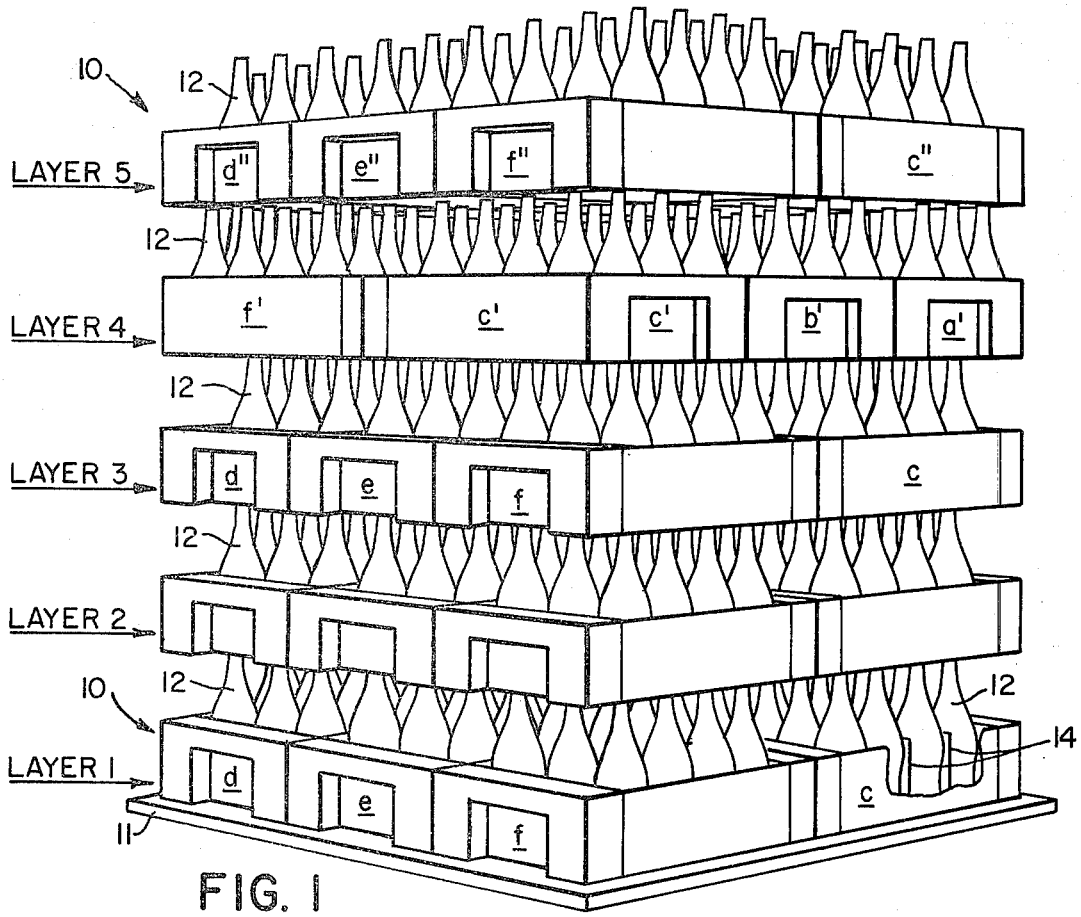
FIG. 1 is a perspective view with parts broken away showing the plastic case system of this invention.

Turning first to FIG. 1 of the drawings, the system is comprised of a number of identical, generally rectangular cases 10 made of a suitable impact-resistant plastic, e.g., linear polyethylene, polypropylene or the like. Often, the cases are placed on a pallet 11. Each case 10 is designed to hold an array of upstanding containers 12 such as soft drink bottles, for example, with the crowns of the bottles projecting up appreciably above the sides of the case. The illustrated cases 10 each hold 12 giant-sized tonic bottles which are arranged in three columns with four bottles in each column. Each bottle is about 3½ inches in diameter and adjacent bottles are about 4 inches apart on center. As such, each case is on the order of 18 inches long, (including about 1½ inch at each end for a handle grip 10*a*), 12 inches wide (including about ½ inch wall thickness at each side 10*b*) and 6 inches deep. Also, if desired, a case 10 may include integral internal spacers to separate the bottles 12 and prevent their contacting one another during handling. Such spacers are shown at 14 in the lower right-hand case 10 in FIG. 1.

Figure 4:
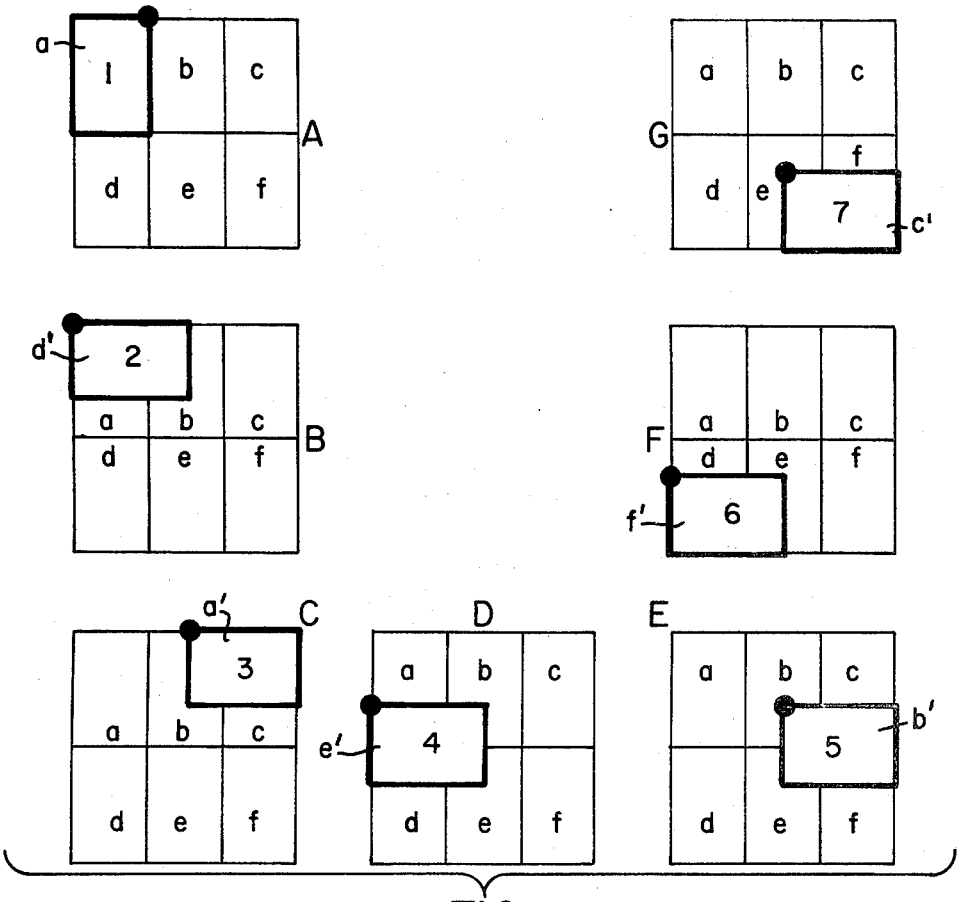
FIGS. 4A to 4G are diagrammatic views showing the different case positions in the system, said positions being related to the occupied keyholes in FIG. 2.

The cases 10 are positioned in a stack composed of five layers numbered 1 to 5 in FIG. 1. As best seen in FIGS. 1 and 4, each layer, in turn, consists of six cases *a* to *f* arranged in two rows of three cases positioned side-by-side.

The cases in layers 1 to 3 are all arranged the same way with each case *a* to *f* in layers 2 and 3 being in register with the corresponding cases in layer 1 as is done conventionally in prior systems of this general type.

Layer No. 4 also contains six cases, *a'* to *f'*. However, this layer is oriented 90° relative to the underlying three layers so that its case *a'* and part of case *b* in the third layer, case *b'* overlies part of the third layer cases *b*, *c*, *e* and *f* and case *c'* overlies case *f* and part of case *e*. The remaining three parallel cases *d'*, *e'* and *f'* cover the remaining portions of the third layer cases *a*, *b*, *d* and *e*.

The cases *a''* to *b''* in layer No. 5 are arranged the same way as those in layers 1 to 3 (i.e., turned 90° relative to layer No. 4) so that they overlie either two or four cases in layer No. 4.

Figure 2:
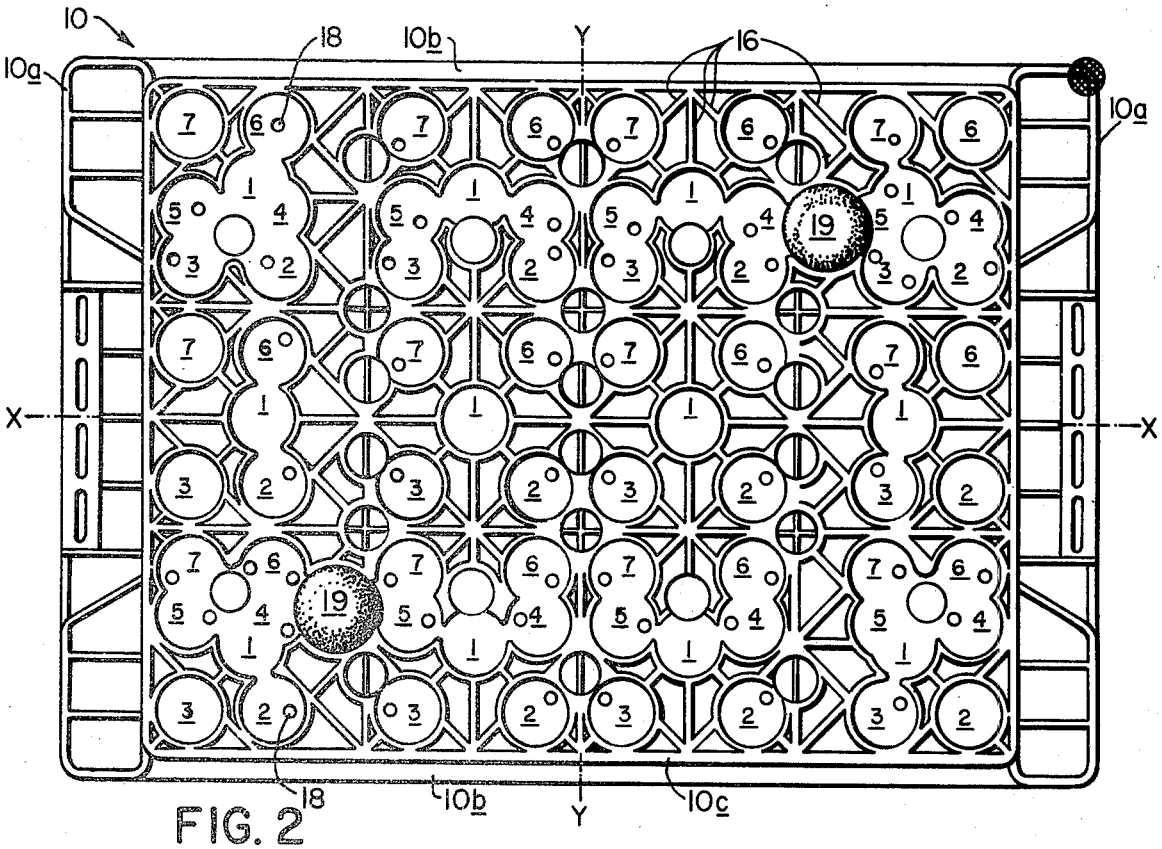
FIG. 2 is a bottom plan view on a larger scale of a single plastic case comprising the FIG. 1 system.
Figure 3:
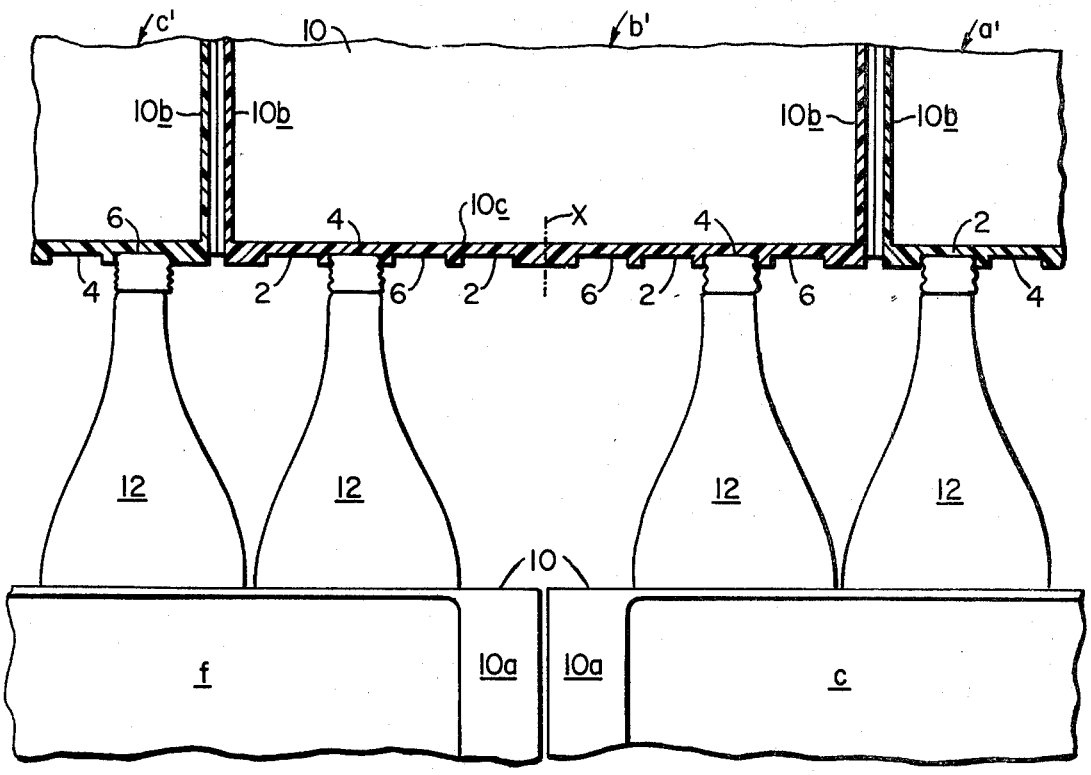
FIG. 3 is a fragmentary sectional view showing in detail the interlocking between adjacent layers in the FIG. 1 system.

Referring now to FIG. 2, each case 10 has a bottom wall 10*c* in the form of a grid of strong ribs 16 and an array of recesses or keyholes 18 interspersed among the ribs. Two rubber grommets 19 are affixed to the bottom wall which frictionally engage an underlying surface to prevent the case from sliding when being filled in the bottling plant.

The keyholes 18 are positioned symmetrically about the X and Y axes in FIG. 2. In other words, each quadrant of the bottom wall 10*a* is substantially a mirror image of the adjacent quadrant so that the entire keyhole array is composed of mirror image repeats of a basic keyhole arrangement in a single bottom wall quadrant. Thus, if FIG. 2 is folded along the X and Y axes, the keyholes in any quadrant are in register with corresponding keyholes in the other quadrants.

Referring now to FIGS. 2 and 4, the recesses or keyholes 18 in the bottom of each case 10 are positioned so that they receive the crowns of the bottles in the underlying case or cases no matter which way the case in question is oriented in the stack. This not only prevents the case from shifting laterally relative to the case or cases below it, but also when criss-crossed as in layer 4 of the FIG. 1 system, locks the underlying cases together to produce a very stable stack.

FIGS. 4A to 4G are diagrams showing the seven possible positions of a given case in a layer of the FIG. 1 system. The six rectangles drawn in relatively light lines represent the six cases *a* to *e* in a given layer in the stack. The darker rectangle represents a case in the layer directly above. The letter associated with the darker rectangle identifies it in conformity with the letter notation in FIG. 1.

Also, the seven different positions of the case in a layer are assigned the numbers 1 to 7. These numbers correspond to the numbers in the keyholes 18 in FIG. 2 which are occupied when the case is in the numbered position shown in FIG. 4. In other words, when the case of FIG. 2 is turned over so that its bottom faces downward as it would be when placed in the stack and is oriented so that the black reference spot at its corner is positioned to place the box in position No. 1 shown in FIG. 4A, the keyholes in FIG. 2 carrying the No. 1 are keyed to the crowns of the bottles in the case directly below it. The other keyholes numbered 2 to 7 are unoccupied for this placement of the case in the stack. This describes the relationship between cases *a* to *f* which are in register in layers 1 to 3.

If the case is now placed in its position No. 2 shown in FIG. 4B, the keyholes carrying the No. 2 are occupied. As seen from FIGS. 1 and 4, the position 2 case in question is case *d'* in layer 4 which rests upon cases *a* and *b* in layer 3. Consequently, the crowns of the bottles from those two different cases project into the keyholes carrying the No. 2. Whereupon, those two cases are locked together by the case at position No. 2 in FIG. 4.

As shown in FIG. 4C, the case *a'* at position No. 3 is shifted laterally relative to position No. 2 so that it overlies cases *b* and *c* in layer 3 and thereby locks those two cases together. At position No. 4 shown in FIG. 4D, the case *e'* is shifted in the opposite direction relative to position No. 2 so that it overlies four cases in layer 3, namely, cases *a*, *b*, *d* and *e*. Consequently, the crowns of the bottles from all four of those cases project into the keyholes numbered 4 in FIG. 2 so that all four of these cases are locked together by the case at position No. 4. Similarly, the case *b'* at position 5 shown in FIG. 4E locks together the four cases *b*, *c*, *e* and *f* in layer 3. At case position No. 6 illustrated in FIG. 4F, the crowns of the bottles in the underlying containers *d* and *e* project into the keyholes carrying the number 6 in FIG. 2 so that those two cases are locked together and, finally, the case *c'* at position No. 7 in FIG. 4G overlies cases *e* and *f* in layer 3 so that the bottles in those cases project into the keyholes carrying the No. 7 in FIG. 2.

Thus, it is apparent that the single case 10 carrying the array of keyholes 18 shown in FIG. 2 is capable of being stacked in register on a similar case below it or arranged so as to overlie more than one case and interlock with the containers in those cases so as to physically lock those cases together and thus stabilize a stack composed of several case layers.

Furthermore, since the arrangement of keyholes 18 is symmetric about both the X and Y axes of the case as shown in FIG. 2, the case can be oriented 180° with respect to its reference position and the keyholes 18 will still be keyed to the underlying containers when the case is in any one of its seven positions shown in FIG. 4. Of course, in this event, the illustrated numbering of the keyholes is reversed in both the X and Y directions to maintain the correspondence between the case position numbers in FIG. 4 and the keyhole numbers in FIG. 2.

While the arrangement of keyholes in the bottom of case 10 is symmetric about the X and Y axes as described above, the arrangement of occupied keyholes in the various case positions shown in FIG. 4 is not. While the keyholes occupied in case position 1 are indeed symmetric about both the X and Y axes as seen in FIG. 2, the keyholes filled in case position 4 are only symmetric about the X axis. The same is true with the keyholes occupied in case position No. 5. On the other hand, the keyholes utilized in the remaining case positions 2, 3, 6 and 7 are not symmetric about either axis. Rather, each of these sets of keyholes bear symmetry with respect to each other. The following table shows the relationship between the different sets of keyholes in the various case positions.

TABLE I

| X Axis Symmetry | Y Axis Symmetry |
|---|---|
| 1 | 1 |
| 4 | 2 and 3 |
| 5 | 4 and 5 |
| 2 and 6 | 6 and 7 |
| 3 and 7 | |

Furthermore, the keyholes for a given case position, with the exception of position 1, are not equally spaced apart in both the X and Y directions. Thus, proceeding leftward from the reference spot in FIG. 2, the distance between the first and second and second and third keyholes No. 2 are the same. However, the space between the third and fourth keyholes numbered 2 is longer by a distance equal to approximately twice the thickness of the case sidewall 10*b*. This is to account for the fact that the case at position No. 2 crosses two underlying cases *a* and *b* so that the spacing between the rightmost bottle in case *a* projecting into the third keyhole No. 2 and the leftmost bottle in case *b* which projects into the fourth keyhole numbered 2 is increased by the thicknesses of the two adjacent case sidewalls 10*b* which total about an inch.

The same holds true with the keyholes numbered 4 extending from any given row toward the left in FIG. 2. That is, the distance between the third and fourth keyhole numbered 4 in a given row is about 1 inch longer than the distance between the first and second and/or the second and third keyholes carrying that number. The same situation prevails with the keyholes numbered 6.

On the other hand, the spacing between the first two keyholes numbered 3, 5 or 7 in a given row is longer by about an inch as compared to the spacing between the other similarly numbered keyholes in the row. This is because the first of each of those keyholes and the second of each of those keyholes are keyed to bottles in different cases as shown in FIG. 4 so that the distances between the first two of each of these numbered keyholes is increased by twice the case sidewall 10*b* thickness.

Still referring to FIG. 2, a somewhat different situation prevails as regards the spacing between the similarly numbered keyholes extending in the Y direction in FIG. 2. There, the spacing between the similarly numbered keyholes are all the same except for keyholes numbered 4 and 5. As seen, there are only two of each of these numbered keyholes in any column along the length of the case as opposed to there being three of each of the other numbered keyholes. This is because the spacing between the keyholes 4 and 5 must be augmented by twice the thickness of the case end 10*a* because, in case positions 4 and 5, the case is interlocked with end-to-end cases in layer 3. Since each case end 10*a* is about 1½ inches, the spacing between keyholes 4 or 5 in a given column is increased by about 3 inches. This means that for a nominal bottle spacing of about 4 inches on center, the total space between the keyholes numbered 4 or 5 in any given column in case 10 is about 7 inches.

With the specially dimensioned and configured case described above, a multilayered stack of cases can be formed in which the cases in some layers or all layers can be interlocked with the cases in other layers in the stack to create a very sturdy structure. The entire stack is built on a pallet and transported without any danger of individual cases, even those at the top of the stack, becoming unstable and falling to the ground. Also, when forming the stack, the different cases can be picked up and positioned without having to locate any particular corner of the case. In other words, a case in any position shown in FIG. 4 can just as well be positioned 180° relative to the illustrated position. When the case is almost seated, the tops of the underlying containers will automatically seat in the keyholes in the case bottom, signifying that the case is in its proper position to interlock the cases below it. Accordingly, a relatively high stack of cases can be formed with a minimum amount of time and effort.

With the aforesaid advantages, this subject case, when incorporated in the system described above, should facilitate the loading and transport of soft drink bottles and the like. Further, it should minimize the changes of those containers being broken during handling. Yet, the case is easily manufactured out of relatively inexpensive plastic material so that it does not add appreciably to the cost of bringing the contained product to market.

It will thus be seen that the objects set forth above, among those made apparent from the preceding description, are efficiently attained and, since certain changes may be made in the above construction without departing from the scope of invention, it is intended that all matter contained in the above description or shown in the accompanying drawings shall be interpreted as illustrative and not in a limiting sense.

It is also to be understood that the following claims are intended to cover all of the generic and specific features of the invention herein described.

I claim:

1. A system of cases comprising one layer of identical generally rectangular plastic cases arranged next to each other, each case holding an array of twelve upstanding containers which extend above the case, said containers being arranged in three columns with four containers in each column, another similar layer of cases resting on the crowns of the containers in said one layer, each of said cases including means defining a bottom wall and an array of recesses in the underside of the bottom wall for receiving the crowns of the underlying containers, said other layer being oriented 90° relative to said one layer so that recesses in the cases in said other layer receive the crowns of containers in at least two different cases in said one layer, said array of recesses being symmetric about both the X and Y axes of the bottom wall so that the array is composed of mirror image repeats of the arrangement of recesses in a single quadrant of the bottom wall and wherein the array of recesses is composed of a plurality of different sets of recesses, a first of said sets being symmetric about both the X and Y axes of the bottom wall, a second and third of said sets being symmetric about only one of said axes, and a plurality of sets and said sets being symmetric about neither of said axes.

2. The system defined in claim 1 wherein there are at least four said layers of cases with the upper cases being keyed to the containers in the underlying cases, thereby forming a stable rectangular stack.

3. The system defined in claim 1 wherein the cases in each layer are arranged in three columns with two cases in each column.

4. The system defined in claim 1 wherein the keyholes in each case in said other layer are arranged so that each said case can be turned 180° about its vertical axis and its keyholes still receive the crowns of the underlying containers.

5. A plastic case for holding an array of upstanding containers of the type having a bottom wall, a pair of spaced-apart parallel side walls projecting up from the bottom wall and a pair of spaced-apart parallel end walls projecting up from the bottom wall and contiguous with the side walls to form a generally rectangular enclosure, the improvement comprising an array of recesses formed in the underside of the bottom wall for receiving the crowns of said containers, said array being symmetric about both the X and Y axes of the bottom wall so that the array is composed of mirror image repeats of the arrangement of recesses in a single quadrant of the bottom wall and wherein the array of recesses is composed of a plurality of different sets of recesses, a first of said sets being symmetric about both the X and Y axes of the bottom wall and the second and third of said sets being symmetric about only one of said axes, a plurality of sets remaining and said sets being symmetric about neither of said axes.

6. The case defined in claim 5 wherein the keyholes in a fourth set of said recesses are symmetric about one of said axes with the keyholes in a fifth set of recesses and symmetric about the other axis with the keyholes in a sixth set of recesses and wherein the keyholes of said seventh set of recesses are symmetric about said one of said axes with the keyholes of the sixth set of said recesses and symmetric about the other of said axis with the keyholes of the fifth set of said recesses and wherein the keyholes in the second set of recesses are symmetric about the other of said axis with the keyholes of said third set of recesses.

7. The case defined in claim 5 wherein the spacing between the recesses in each of said second and third sets of recesses is longer in a direction parallel to the other of said axes by a distance equal to twice the thickness of the case end wall than the distance between said recesses as measured parallel to the one of said axis and wherein the spacing between selected adjacent recesses in each of said fourth to seventh sets of recesses are longer in a direction parallel to said one axis by a distance equal to twice the case side wall thickness than the distance between the remaining adjacent recesses in the fourth to seventh sets of recesses.

* * * * *